US005779450A

United States Patent [19]

Fujiwara et al.

[11] Patent Number: 5,779,450

[45] Date of Patent: Jul. 14, 1998

[54] REFRIGERATING APPARATUS HAVING A FLUID COMPRESSOR

[75] Inventors: Takayoshi Fujiwara, Tokyo; Yoshinori Sone, Yokohama; Takashi Honjo, Kawasaki; Takuya Hirayama, Fujisawa; Syunro Kawaguchi, Yokosuka; Teruhisa Tsunekawa, Yokohama, all of Japan

[73] Assignee: Kabushiki Kaisha Toshiba, Kawasaki, Japan

[21] Appl. No.: 569,688

[22] Filed: Dec. 8, 1995

[30] Foreign Application Priority Data

Dec. 8, 1994 [JP] Japan ..... 6-304958

[51] Int. Cl.[6] ..... F04B 49/06

[52] U.S. Cl. ..... 417/45; 418/220

[58] Field of Search ..... 417/12, 45, 356; 418/220; 62/215, 228.4, 323.3, 323.4; 318/696, 807, 811

[56] References Cited

U.S. PATENT DOCUMENTS

| | | | |
|---|---|---|---|
| 3,579,279 | 5/1971 | Inaba et al. | 318/696 |
| 3,766,462 | 10/1973 | Kubo et al. | 318/696 |
| 4,489,267 | 12/1984 | Saar et al. | 318/811 |
| 4,871,304 | 10/1989 | Iida et al. . | |
| 4,959,969 | 10/1990 | Okamoto et al. | 62/157 |
| 4,989,414 | 2/1991 | Murayama et al. | 62/228.4 |
| 5,090,874 | 2/1992 | Aikawa et al. | 417/356 |
| 5,350,992 | 9/1994 | Colter | 318/807 |
| 5,360,326 | 11/1994 | Okuda et al. | 418/220 |
| 5,518,373 | 5/1996 | Takagi et al. | 417/45 |

*Primary Examiner*—Jack B. Harvey
*Assistant Examiner*—Xuan M. Thai
*Attorney, Agent, or Firm*—Cushman Darby & Cushman IP Group of Pillsbury Madison & Sutro LLP

[57] ABSTRACT

A fluid compressor has a sealed case, an electric motor section, and a compression section. Both sections are provided in the sealed case, with their axes extending substantially horizontally. The sealed case is filled with lubricant. At the start of the compressor, the rotational speed N of the electric motor section is gradually increased, but maintained at least once at a prescribed value for a predetermined period. At the stop of the compressor, the rotational speed N is gradually decreased, but maintained at least once at a prescribed value for a predetermined period.

13 Claims, 6 Drawing Sheets

FIG. 8A
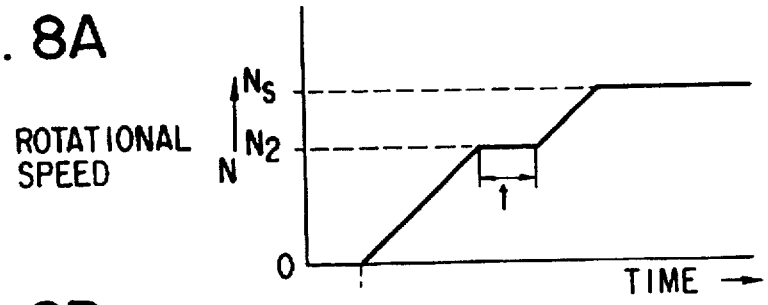
FIG. 8B
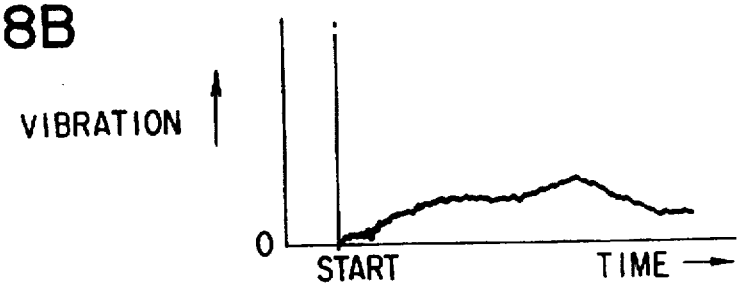
FIG. 9A
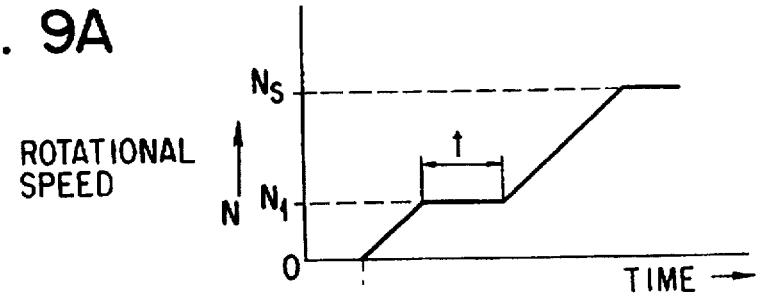
FIG. 9B
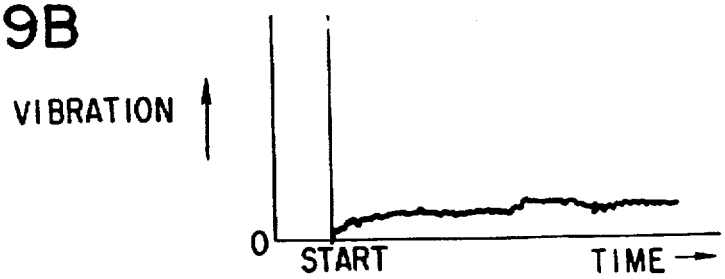
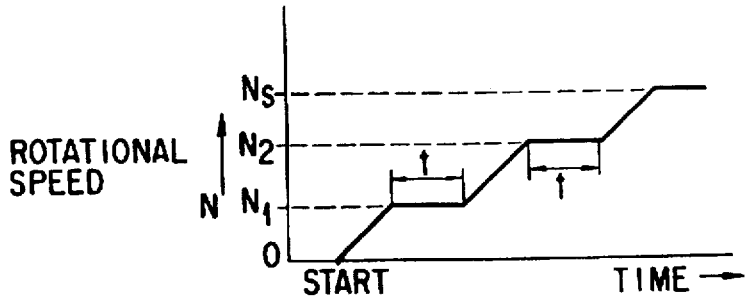
FIG. 10

REFRIGERATING APPARATUS HAVING A FLUID COMPRESSOR

BACKGROUND OF THE INVENTION

1. Field of the Invention

The present invention relates to a refrigerating apparatus having a fluid compressor which is so arranged that its axis extends substantially horizontally.

2. Description of the Related Art

Known as a sealed-type compressor for use in a refrigerating cycle is a so-called "fluid compressor." A fluid compressor comprises a sealed case, a compression section, and an electric motor section. The sealed case contains both the compression section and the electric motor section and is filled with lubricant. The fluid compressor is comparatively simple in structure, excels in fluid-tightness, and can compress fluid efficiently. Its components are easy to manufacture and assemble together.

The sealed case is a hollow cylinder closed at both ends. The case is positioned with its axis extending substantially horizontally. Provided in the case thus positioned, the compression section and the electric motor section have their axes extending substantially horizontally.

The compression section comprises a cylinder, a piston, and a spiral blade. The cylinder can rotate around its axis. The piston is rotatably inserted in the cylinder and arranged eccentric to the cylinder. The spiral blade is loosely fitted in a spiral groove cut in the circumferential surface of the piston and can project from the spiral groove and recede thereinto. The blade, the circumferential surface of the piston and the inner circumferential surface of the cylinder define a compression chamber.

When the cylinder and the piston are rotated together by the electric motor section, the gaseous refrigerant in the refrigerating cycle is drawn into the compression chamber through a suction pipe. The refrigerant is compressed in the compression chamber, fed from the chamber into the sealed case, and supplied from the case into the refrigerating cycle through a discharge pipe.

The electric motor section comprises a stator and a rotor. The stator is secured to the inner circumferential surface of the sealed case. The rotor is mounted on the outer circumferential surface of the cylinder.

The lubricant accumulates on the bottom of the sealed case. It is drawn upwards from the bottom and supplied to the compression section and the electric motor section, to lubricate any sliding components provided in these sections.

When the fluid compressor is activated, the rotational speed N of the electric motor section quickly increases to a value $N_s$. Until the speed of the compressor reaches the value $N_s$, the compressor vibrates greatly and makes much noise.

In the sealed case, the compression section and the electric motor section are immersed in part in the lubricant accumulated at the bottoms of the sealed case. The rotating electric motor section violently stirs the lubricant, inevitably turning the lubricant into foam. The foamed lubricant is drawn upwards, along with the refrigerant gas. As a result, the amount of lubricant in the sealed case becomes less than required to lubricate the sliding components of the electric motor and compression sections.

When the fluid compressor is stopped, the rotational speed N of the electric motor section abruptly decreases. Until the compressor is completely stopped, it is violently vibrated and makes much noise. To make matters worse, a long time elapses after the compressor is completely stopped until the pressures Pd and Ps at the high-pressure and low-pressure sides of the refrigerating cycle are balanced with each other.

Until the pressures Pd and Ps are balanced, there remains a pressured difference between the inlet and outlet ports of the cylinder which is contained in the sealed case. Due to this pressure difference, the surface of the lubricant rises to a level near the cylinder. As a consequence, the lubricant may flow into the compression chamber in some cases.

Once flowed into the compression chamber, the lubricant flows into the suction pipe. This is because the pressure in the suction pipe is low. The lubricant would remain in the suction pipe since there is no means for discharging the lubricant. The lubricant is drawn into the cylinder—that is, into the compression chamber. So-called "liquid compression" occurs, shortening the the lifetime of the fluid compressor.

SUMMARY OF THE INVENTION

The object of the present invention is to provide a refrigerating apparatus having a fluid compressor which vibrates only a little and makes little noise when started and in which the lubricant is not foamed at start of the compressor and can well lubricate the compression section and electric motor section.

According to the invention, there is provided a refrigerating apparatus which comprises: a fluid compressor having a sealed case filled with lubricant, a compression section provided in the sealed case, and an electric motor section provided in the sealed case, the compression section and the electric motor section having axes extending substantially horizontally; and a control section for gradually increasing the rotational speed of the electric motor section when the fluid compressor is started.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 8A and 8B are graphs representing a relationship which the rotational speed N of the electric motor section and the vibration caused by the electric motor section assume in the second embodiment at the start of the fluid compressor;

FIG. 9A and 9B are graphs is a graph representing another relationship which the rotational speed N of the electric motor section and the vibration caused by the electric motor section assume in the second embodiment at the start of the fluid compressor; and FIG. 10 is a graph representing still another relationship which the rotational speed N of the electric motor section and the vibration caused by the electric motor section assume in the second embodiment at the start of the fluid compressor.

DETAILED DESCRIPTION OF THE PREFERRED EMBODIMENTS

Embodiments of the present invention will be described, with reference to the accompanying drawings.

Figure 2:
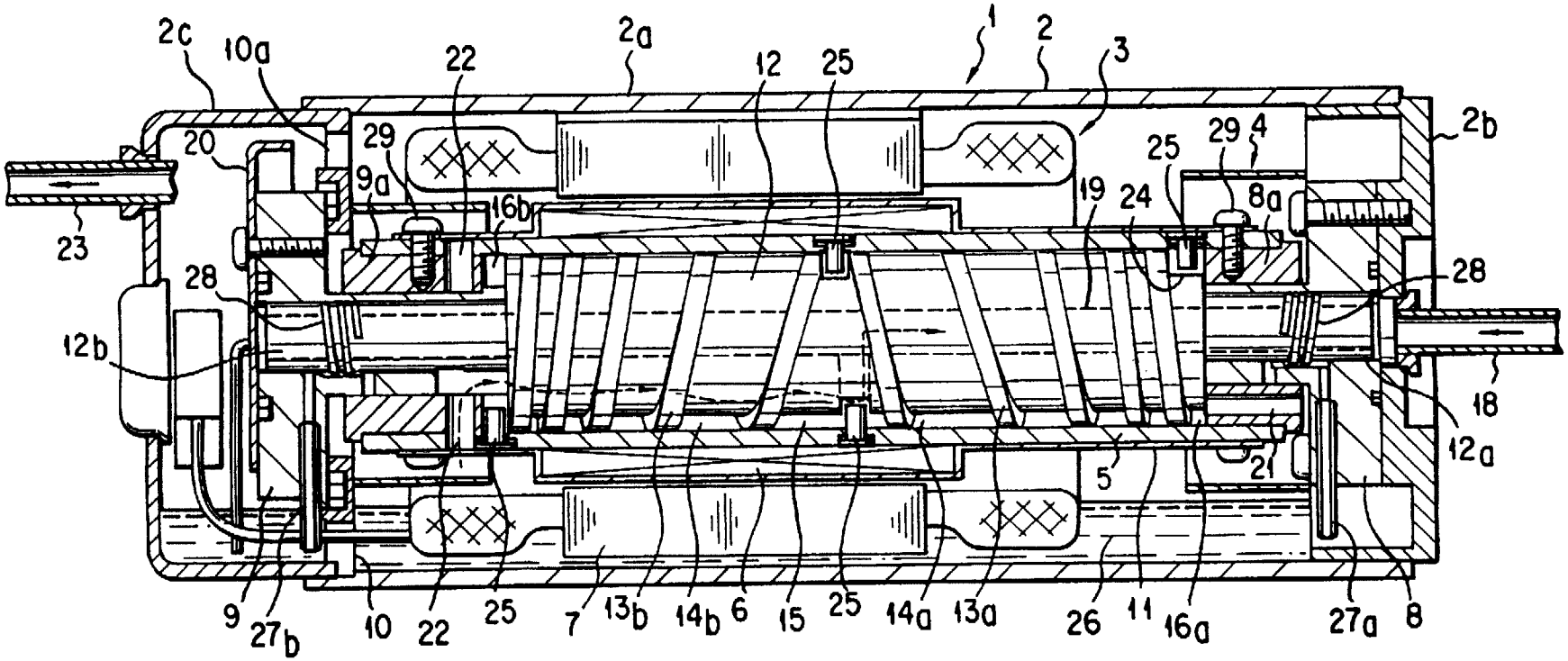
FIG. 2 is a sectional view of the fluid compressor provided in each embodiment of the invention.

As shown in FIG. 2, the fluid compressor 1 for use in the present invention comprises a sealed case 2, an electric motor section 3, and a compression section 4.

The sealed case 2 comprises a hollow cylindrical main body 2*a* and two covers 2*c* and 2*b*. The first cover 2*a* closes one end of the main body 2*a*. The second cover 2*b* closes the other end of the main body 2. The sealed case 2 is positioned, with its axis extending substantially horizontally.

The electric motor section 3 and the compression section 4 are provided in the sealed case 2. Both sections 3 and 4 are positioned, with their axes extending substantially horizontally.

The compression section 4 has a rotatable cylinder 5. A cylindrical sheath 11 made of non-magnetic material is mounted on the cylinder 5.

A rotor 6, which is a ring-shaped permanent magnet, is mounted on the sheath 11. A stator 7 is secured to the inner circumferential surface of the sealed case 2. Three phase windings U, V and W are wound around the stator 7. An electric power is supplied to these windings U, V and W sequentially, to two phase windings at a time and the rotor 6 is rotated. Namely, the rotor 6, the stator 7 and the phase windings U, V and W constitute the electric motor section 3, which is a brushless DC motor.

A main bearing 8 is secured to the center of the cover 2*b*. To the main bearing 8 a first cylinder bearing 8*a* is rotatably coupled. The first cylinder bearing 8*a* is loosely inserted in the opening made in one end of the cylinder 5. This opening is closed in airtight fashion by the main bearing 8 and the first cylinder bearing 8*a*.

A partition 10 is provided between the main body 2*a* and the cover 2*c*. To the partition 10 an auxiliary bearing 9 is fastened. A second cylinder bearing 9*a* is rotatably mounted on the auxiliary bearing 9 and loosely fitted in the opening made in the other end of the cylinder 5. This opening is closed in airtight fashion by the auxiliary bearing 9 and the second cylinder bearing 9*a*.

The cylinder 5 contains a piston 12, which can rotate and is coaxial with the cylinder 5. The piston 12 has two shafts 12*a* and 12*b* at its ends. The shaft 12*a* is rotatably supported by the first cylinder bearing 8*a* and the main bearing 8. The shaft 12*b* is rotatably supported by the second cylinder bearing 9*a* and the auxiliary bearing 9. The piston 12 has a diameter smaller than the inner diameter of the cylinder 5 and is arranged eccentric to the cylinder 5. Therefore, only a part of the circumferential surface of the piston 12 contacts the inner circumferential surface of the cylinder 5.

Near the auxiliary bearing 9 and between the cylinder 5 and the piston 12, there is provided a rotation-transmitting section (not shown). This section is a so-called Oldam mechanism comprising the cylinder bearing 9*a* and an Oldam ring. The rotation-transmitting section mechanically connects the piston 12 to the cylinder 5 so that the piston 12 may rotate when the cylinder 5 rotates.

The piston 12 has two spiral grooves (not shown) formed in its circumferential surface. The first spiral groove extends from the middle part of the piston 12 to one end thereof, and the second spiral groove from the middle part of the piston 12 to the other end thereof. Each spiral groove has turns arranged at a pitch which gradually decreases toward the end of the piston 12.

Two spiral blades 13*a* and 13*b* are loosely fitted in the first and second spiral grooves, respectively. Both blades 13*a* and 13*b* are made of material having a low friction coefficient, such as fluorocarbon resin. The blades 13*a* and 13*b* are substantially as thick as the spiral grooves are wide. They are elastically deformed to expand in the radial direction of the piston 12. Once set in the cylinder 5, the spiral blades 13*a* and 13*b* can slide, with their outer edge surfaces contacting the inner circumferential surface of the cylinder 5.

The first spiral blade 13*a* defines a first compression chamber 14*a*, jointly with the inner circumferential surface of the cylinder and the circumferential surface of the piston 12. Similarly, the second spiral blade 13*b* defines a second compression chamber 14*b*, jointly with the inner circumferential surface of the cylinder and the circumferential surface of the piston 12. Each compression chamber is a helical passage having a cross section which gradually decreases from the middle part of the piston 12 toward the end thereof.

A refrigerant passage 19 extends through the piston 12 and both shafts 12*a* and 12*b*. The passage 19 opens at the distal ends of the shafts 12*a* and 12*b*. A short refrigerant passage branches from the midpoint of the passage 19, extends in the radial direction of the piston 12 and opens at the outer circumferential surface of the piston 12.

A suction pipe 18 is connected at one end to the cover 2*b* of the sealed case 2 and at the other end to a refrigerating cycle device (not shown). The suction pipe 18 communicates with the refrigerant passage 19 at the outer end of the shaft 12*a*.

The refrigerant passage 19 is closed at the distal end of the shaft 12*b* by means of a cover 20. The cover 20 is fixed to the auxiliary bearing 9. The passage 19 has a branch which opens at the circumferential surface of the piston 12. The branch opens into that part of the compression chamber 14*a* which has the largest cross section, and also into that part of the compression chamber 14*b* which has the largest cross section. The branch acts as a suction port 15 which communicates with both compression chambers 14*a* and 14*b*.

That portion of the compression chamber 14*a* which is adjacent to the shaft 12*a* and which has the smallest cross section functions as a discharge port 16*a*. Similarly, that portion of the compression chamber 14*b* which is adjacent to the shaft 12b and which has the smallest cross section functions as a discharge port 16b.

The cylinder bearing 8a has a guide hole 21. The hole 21 extends though the cylinder bearing 8a, for guiding the compressed refrigerant compressed from the chamber 14a through the discharge port 16a and from the cylinder 5. The cylinder bearing 9a has a guide hole 22. The hole 22 extends through the cylinder bearing 9a, the cylinder 5 and the cylindrical sheath 11, for guiding the compressed refrigerant compressed from the chamber 14b through the discharge port 16b and from the cylinder 5.

The partition 10 provided between the main body 2a and the cover 2c has a plurality of guide holes 10a. By virtue of these holes 10a the space in the main body 3a communicates with the space in the cover 2c. The cover 2c has a discharge pipe 23 which is to be connected to the refrigerating cycle device (not shown).

Grooves 24 are made in both end portions and middle portion of the piston 12. Blade stoppers 25 are fitted in these grooves 25, preventing the blades 13a and 13b from slipping out of the first and second spiral grooves of the piston 12, respectively.

The sealed case 2 is filled with lubricant. The lubricant accumulates at the bottom of the sealed case 2, forming a mass 26 of lubricant. Both electric motor section 3 and the compression section 4 are immersed, in part, in the mass 26 of lubricant. So is the lower portions of suction pipes 27a and 27b. The first suction pipe 27a is partly embedded in the main bearing 8 and has its upper end opposing the circumferential surface of the shaft 12a. The second suction pipe 27b is partly embedded in the auxiliary bearing 9 and has its upper end opposing the circumferential surface of the shaft 12b.

Two oiling pumps 28, each comprising a spiral blade, are provided on the circumferential surfaces of the shafts 12a and 12b, respectively. The first oiling pump 28 receives the lubricant sprayed from the suction pipe 27a and supplies it to the mutually contacting surfaces of the main bearing 8 and shaft 12a. Similarly, the second oiling pump 29 receives the lubricant sprayed from the suction pipe 27b and supplies it to the mutually contacting surfaces of the auxiliary bearing 9 and shaft 12b.

The first cylinder bearing 8a has a screw hole; so does the second cylinder bearing 9a. Two screws 29 are set in the screw holes, fasting the cylinder 5, the cylindrical sheath 11 and the piston 12 to the cylinder bearings 8a and 9a.

The fluid compressor 1 shown in FIG. 2 is incorporated in the refrigerating cycle. The refrigerating cycle will be described with reference to FIG. 3.

Figure 3:
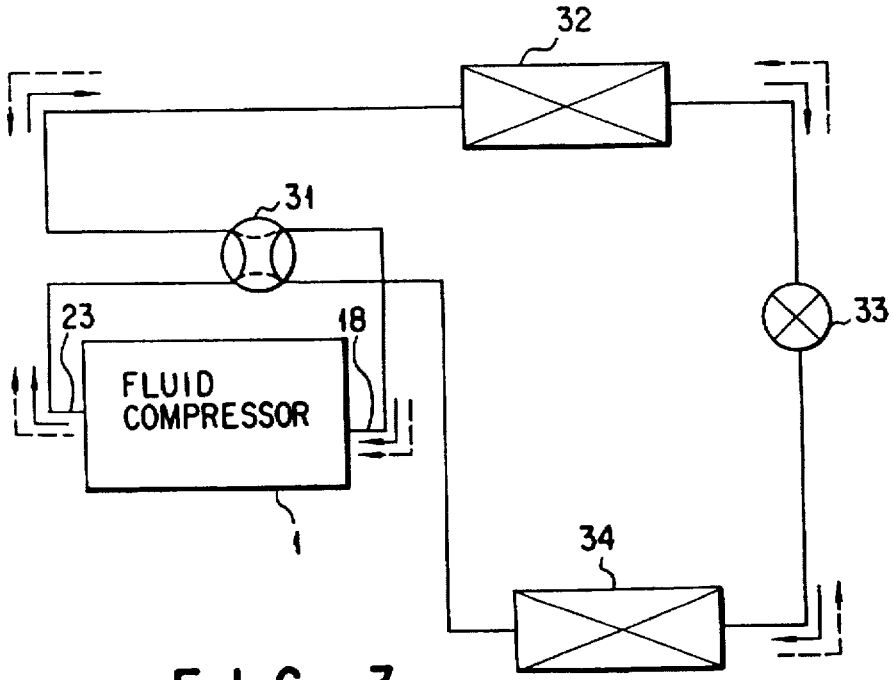
FIG. 3 is a diagram showing the refrigerating cycle incorporated in each embodiment of this invention.

As illustrated in FIG. 3, the refrigerating cycle comprises a four-way valve 31, an outdoor heat exchanger 32, an expansion valve 33 and indoor heat exchanger 34, in addition to the fluid compressor 1. One end of the outdoor heat exchanger 32 is connected by the four-way valve 31 to the discharge pipe 23 of the fluid compressor 1. The other end of the outdoor heat exchanger 32 is connected by the expansion valve 33 to one end of the indoor heat exchanger 34. The other end of the indoor heat exchanger 34 is connected by the four-way valve 31 to the suction pipe 18 of the fluid compressor 1.

During the cooling operation, the refrigerant flows through a path indicated by the solid-line arrows in FIG. 3. More precisely, it flows from the fluid compressor 1 through the four-way valve 31 into the outdoor heat exchanger 32, and hence into the indoor heat exchanger 34 through the expansion valve 33. Having passed through the indoor heat exchanger 34, the refrigerant flows back into the fluid compressor 1 via the four-way valve 31. During the cooling operation, the outdoor heat exchanger 32 and the indoor heat exchanger 34 function as condenser and evaporator, respectively.

To start the heating operation, the fluid passage is switched in the four-way valve 31, whereby the refrigerant flows through a path indicated by the broken-line arrows in FIG. 3. To be more specific, it flows from the fluid compressor 1 via the four-way valve 31 into the indoor heat exchanger 34, and hence into the outdoor heat exchanger 32 through the expansion valve 33. After passing through the outdoor heat exchanger 32, the refrigerant flows back into the fluid compressor 1 via the four-way valve 31. During the heating operation, the indoor heat exchanger 34 and the outdoor heat exchanger 32 function as condenser and evaporator, respectively.

The control circuit incorporated in the refrigerating apparatus will be described, with reference to FIG. 1.

Figure 1:
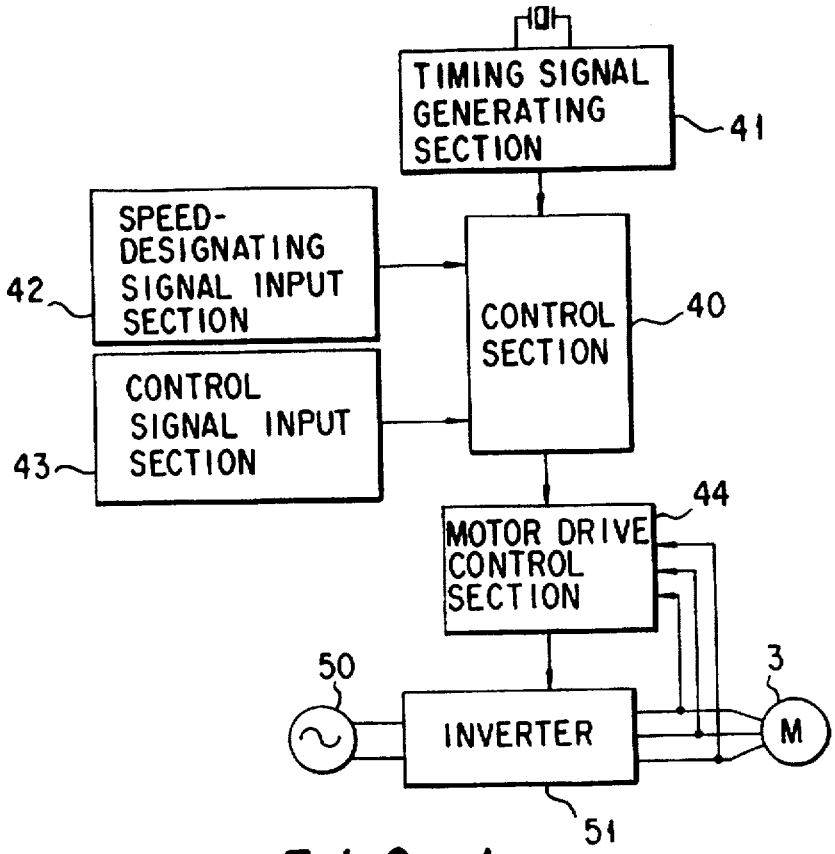
FIG. 1 is a block diagram of the control circuit incorporated in each embodiment of the invention.

As shown in FIG. 1, the control circuit comprises a control section 40, a timing signal generating section 41, a speed-designating signal input section 42, a control signal input section 43, and a motor drive control section 44. The control section 40 is provided to control the components of the refrigerating cycle (FIG. 3), among which is the fluid compressor 1. To the control section 40, there are connected the sections 41, 42, 43 and 44.

An inverter 51 has a DC voltage circuit for rectifying the AC voltage from the AC power supply 50 and outputting an obtained DC voltage. The inverter 51 has switching elements, which are turned on and off repeatedly to convert the DC voltage from the DC voltage circuit to the voltage having the predetermined frequency. The output voltage of the inverter 51 is applied to the electric motor section 3 which is, as mentioned above, a brushless DC motor.

The timing signal generating section 41 which generates various timing signals (clock signals) used as control signals. The speed-designating signal input section 42 supplies a speed-designating signal to the control section 40. This signal is to set the number N of revolutions the section makes per unit time (hereinafter referred to as "rotational speed N") at a predetermined value $N_s$. The predetermined value $N_s$ is designated by control section provided on an apparatus, for example an air conditioner, which incorporates in the refrigerating apparatus. The value Ns will be called "designated speed $N_s$" hereinafter.

The control signal input section 43 supplies control signals generated at the air conditioner, to the control section 40. The motor drive control section 44 determines the reference rotational position of the rotor 6 of the section 3 from the voltage induced in one of the phase windings U, V and W on the stator 7 of the electric motor section 3, through which no power is supplied. The section 44 turns on and off the switching elements of the inverter 51 with specific timing based on the reference rotational position the rotor 6 assumes. The phase windings U, V and W on the stator 7 of the section 3 are thereby sequentially supplied with a power, two phase windings at a time. Thus, the electric motor section 3 is driven.

The voltage output from the inverter 51 is a three-phase voltage. The frequency of the three-phase voltage is determined by the timing of turning on and off the switching elements of the inverter 51. The frequency of the three-phase voltage will be referred to as "output frequency F." The output frequency F determines the intervals at which the power is supplied to the phase windings U, V and W, two phase windings at a time.

The motor drive control section 44 changes the output frequency F of the inverter 51 in accordance with an instruction supplied from the control section 40. The rotational speed N of the electric motor section 3 is thereby changed. A maximum frequency allowable value Fmax is set for the output frequency F of the inverter 51, and the inverter 51 cannot output a three-phase voltage having a frequency which surpasses this value Fmax.

The control section 40 comprises the following functional means:

1. First means for gradually raising the output frequency F of the inverter 51 at the start of the fluid compressor 1, thereby gradually increasing the rotational speed N of the section 3.

2. Second means for gradually lowering the output frequency F of the inverter 51 at the stop of the fluid compressor 1, thereby gradually decreasing the rotational speed N of the section 3.

3. Third means for maintaining the output frequency F at least once, at a prescribed value for a predetermined period at the stop of the fluid compressor 1, thereby to keep the rotational speed N of the section 3, at least once, at a particular value for that predetermined period.

Figure 4:
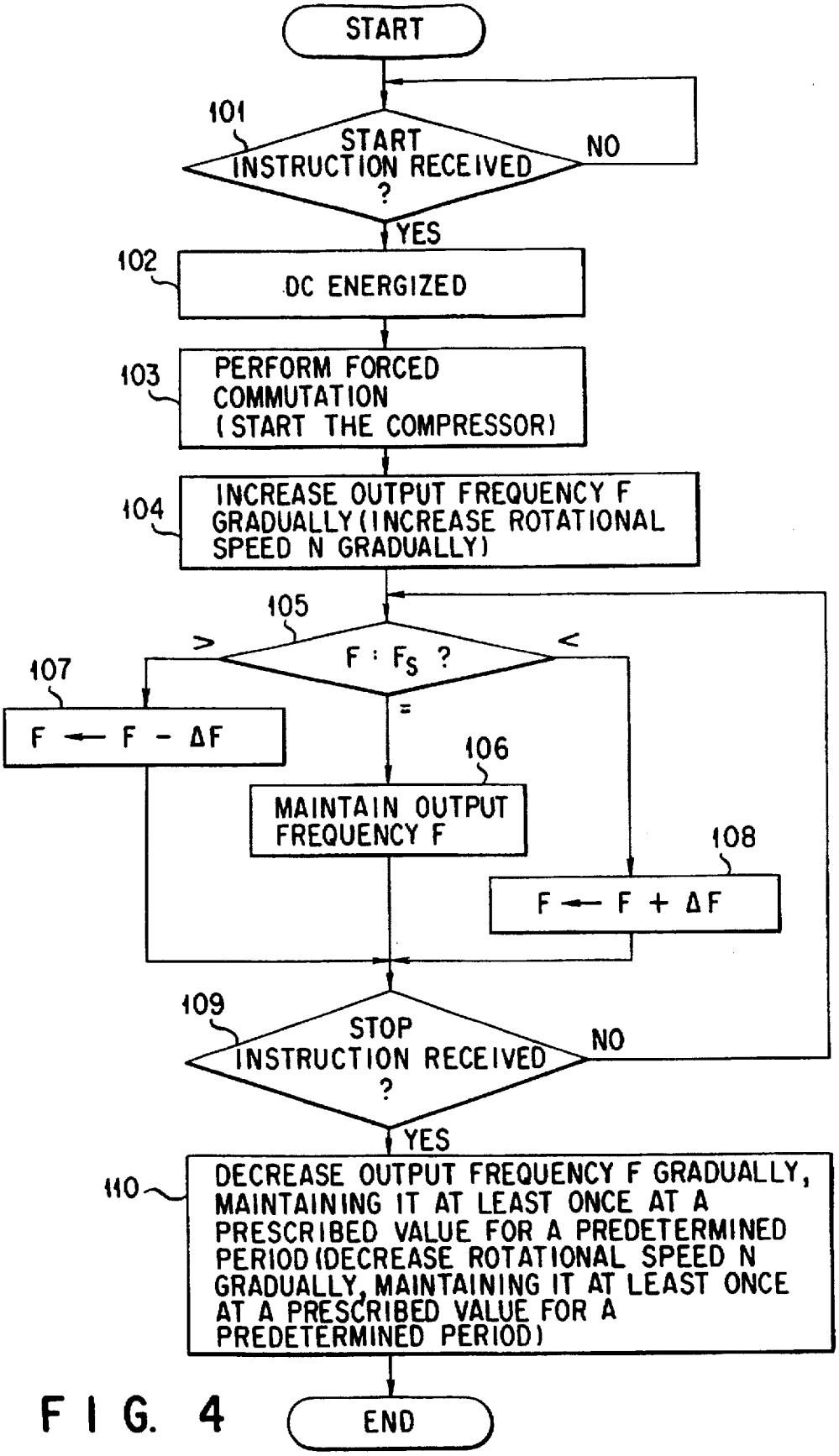
FIG. 4 is a flow chart explaining the operation of a refrigerating apparatus according to the first embodiment of the invention.
Figure 5A:
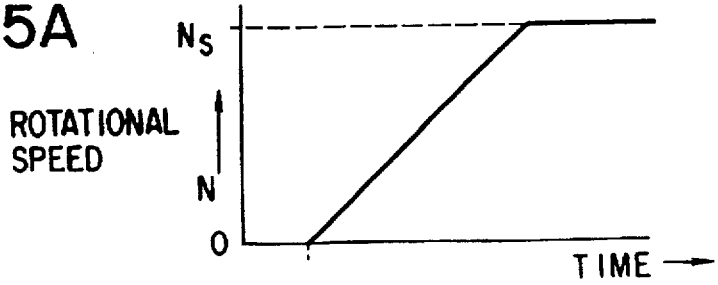
FIGS. 5A and 5B are graphs is a graph representing the relationship which the rotational speed N of the electric motor section and the vibration caused by the electric motor section assume in the first embodiment at the start of the fluid compressor.
Figure 5B:
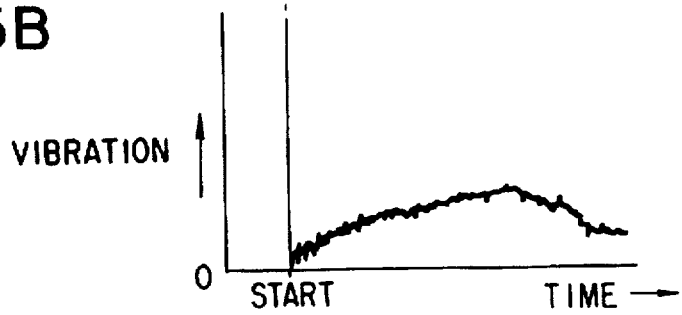
Figure 6A:
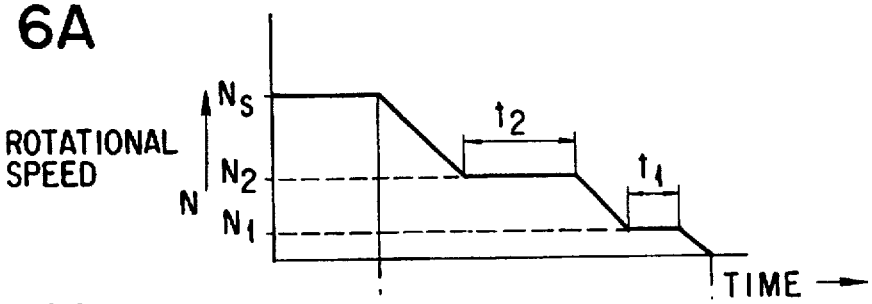
FIGS. 6A, 6B, and 6C are diagrams illustrating the relationship which the rotational speed N of the electric motor section and the vibration caused by the electric motor section assume, and the relationship which the pressures at the high- and low-pressure sides of the refrigerating cycle assume, in the first embodiment at the stop of the fluid compressor.
Figure 6B:
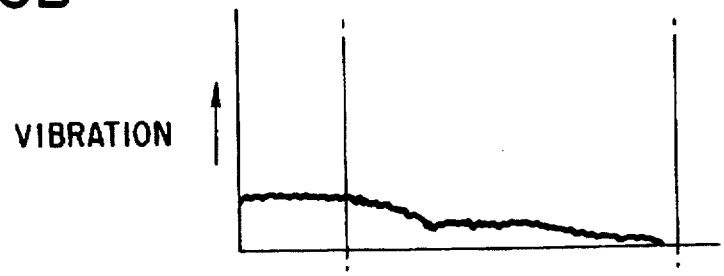
Figure 6C:
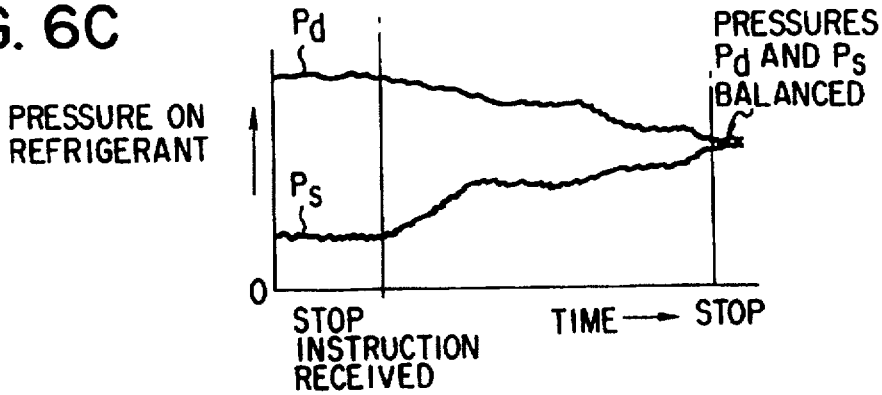

How the refrigerating apparatus operates will now be explained, with reference to FIG. 4 which is a flow chart.

At first, in Step 101, it is determined whether or not a start instruction has been supplied from the control section provided on the air conditioner incorporating the refrigerating apparatus. If NO Step 101 will be repeated. If YES, the operation goes to Step 102. In Step 102, the phase windings on the stator 7 of the electric motor section 3 are energized by DC voltage from the inverter, thereby to moving the rotational position of the rotor 6 to an optimum position. As a result the fluid compressor 1 smoothly starts and prevent the rotor 6 from rotating in the reverse direction.

Then in Step 103, forced commutation is performed on the electric motor section 3. This is because the reference rotational position of the rotor 6 cannot be detected accurately at first. The forced commutation is accomplished by supplying a power to the phase windings U, V and W, two phase windings at a time, with prescribed timing.

Upon completion of the forced commutation, the output frequency F of the inverter 51 is gradually increased in Step 104, toward a target value Fs corresponding to the designated speed $N_s$ which is represented by a signal supplied from the air conditioner. The rotational speed N of the section 3 gradually increases, not abruptly, at the start of the fluid compressor 1. Hence, the compressor 1 vibrates much less and makes far less noise than its counterpart incorporated in the conventional refrigerating apparatus.

At the start of the fluid compressor 1, the lubricant at the bottom of the sealed case 2 may be quickly stirred by a rotating component of the electric motor section 3 (e.g., the rotor 6) and may be foamed. Should the lubricant be thus foamed, the refrigerant gas would be drawn upwards from the suction pipes 27*a* and 27*b*, along with the lubricant. Then, the sliding components of the electric motor section 3 and the compression section 4 could no longer be lubricated sufficiently.

Nevertheless, the lubricant at the bottom of the sealed case 2 is not abruptly stirred because the rotational speed N of the section 3 increases gradually. The foaming of the lubricant is therefore prevented. Only the lubricant is drawn upwards from the suction pipes 27*a* and 27*b*. As a result, the sliding components of the electric motor section 3 and the compression section 4 are lubricated well.

An optimal value for the rate of increasing the output frequency F of the inverter 51 ranges from 0.1 to 5 Hz/sec. Once the output frequency F reaches the target value Fs, it is maintained at the target value Fs by the following method. At first, in Step 105 the output frequency F is compared with the target frequency Fs. If the frequency F is equal to the frequency Fs, the output frequency F is maintained in Step 106. If the frequency F is higher than the target frequency Fs, it is decreased by Δ F in Step 107. If the frequency F is lower than the target frequency Fs, it is increased by Δ F in Step 108.

When the electric motor section 3 starts, the cylinder 5 is rotated. The rotation of the cylinder 5 is transmitted to the piston 12, rotating the piston 12. Since the piston 12 is positioned eccentrically to the cylinder 5, its circumferential surface is kept in contact, in part, with the inner circumferential surface of the cylinder 5. Both spiral blades 13*a* and 13*b* provided on the piston 12 are rotated, with their edge surfaces contacting the inner circumferential surface of the cylinder 5.

The refrigerant under low pressure is drawn via the suction pipe 18 into the refrigerant passage 19. The refrigerant then flows into both compression chambers 14*a* and 14*b*. In the chambers 14*a* and 14*b*, the refrigerant is forced toward the discharge ports 16*a* and 16*b* and gradually compressed as the cylinder 5, electric motor section 3 rotates the piston 12 and spiral blades 13*a* and 13*b*. The refrigerant thus compressed is discharged from the discharge ports 16*a* and 16*b* and flows through the guide holes 21 and 22 into the sealed case 2, filling the space in the case 2. The refrigerant under high pressure is supplied from the sealed case 2 to the refrigerating cycle through the discharge pipe 23.

As the refrigerant is compressed, a pressure is applied onto both spiral blades 13*a* and 13*b*. Notwithstanding, the blades 13*a* and 13*b* are prevented from slipping from the spiral groves of the piston 12 by the blade stoppers 25 fitted in the grooves 24. This ensures a high compression efficiency.

In Step 109, it is determined whether or not a stop instruction has been supplied from the control section provided on the air conditioner incorporating the refrigerating apparatus. If YES, the output frequency F of the inverter 51 is gradually decreased in Step 110. More precisely, the output frequency F first remains at a prescribed value $F_2$ for a predetermined period $t_2$ and then at a prescribed value $F_1$ for a predetermined period $t_1$, where $F_1$ is less than $F_2$.

As the output frequency F is gradually decreased, the rotational speed N of the electric motor section 3 gradually decreases as is illustrated in FIG. 8A. The speed N remains at a prescribed value $N_2$ for the period $t_2$ and then at a prescribed value $N_1$ for the period $t_1$. The value $N_1$ is less than the value $N_2$.

Since the rotational speed N of the electric motor section 3 is decreased gradually, step by step, to stop the fluid compressor 1, the compressor 1 vibrates much less and makes far less noise than its counterpart incorporated in the conventional refrigerating apparatus.

In addition, since the rotational speed N of the section 3 is decreased gradually, stepwise, the pressures Pd and Ps at the high-pressure and low-pressure sides of the refrigerating cycle are balanced with each other within a short time after the fluid compressor 1 is stopped.

During the time which lapses until the pressures Pd and Ps become balanced, there remains a difference between the pressures at the discharge port 16*a* and suction port 15 of the cylinder 5, and also a difference between the pressures at the discharge port 16*a* and suction port 15 of the cylinder 5. If the time is long, the surface of the lubricant at the bottom of the sealed case 2 may rise to a level near the cylinder 5, and the oil may flow into the compression chamber 14*b* through the discharge port 16*b* and hence into the refrigerant passage 19 provided in the piston 12 through the suction port 15 of the cylinder 5.

If the lubricant flowed into the refrigerant passage 19, it would then flow from the passage 19 back into the suction pipe 18 and finally accumulate therein. Consequently, the lubricant would be drawn into the cylinder 5 at the start of the fluid compressor 1, and so-called "liquid compression" would result in. The liquid compression would shorten the lifetime of the liquid compressor 1.

At the start of the liquid compressor 1, the lubricant is readily prevented from flowing back into the suction pipe 18 or the refrigerant passage 19 since, as mentioned above, the pressures Pd and Ps at the high-pressure and low-pressure sides of the refrigerating cycle are balanced within a short time. No liquid compression takes place, and the lifetime of the liquid compressor 1 is not shortened.

Furthermore, since the electric motor section 3 is a brushless DC motor, the fluid compressor 1 consumes less electric power and can operated more efficiently than a fluid compressor having an AC motor which cannot operate without a "slip."

An optimal value for the rate of decreasing the output frequency F of the inverter 51 ranges from 0.1 to 5 Hz/sec. Optimal values for the predetermined periods $t_1$, and $t_2$ range from 5 seconds to 3 minutes. Optical values for the prescribed output frequency $F_1$ and $F_2$ range from 5% to 30% of the maximum frequency allowable value Fmax.

Nonetheless, the output frequency F may be maintained only once or three times or more. It suffices to maintain the output frequency F at least one time to achieve the above-mentioned advantages.

Another refrigerating apparatus which is the second embodiment of the invention will be described.

The second embodiment is identical to the first embodiment, except that the control section 40 comprises the following functional means:

1. First means for gradually raising the output frequency F of the inverter 51 at the start of the fluid compressor 1, thereby to gradually increasing the rotational speed N of the section 3.

2. Fourth means for maintaining the output frequency F at least once, at a prescribed value for a predetermined period at the start of the fluid compressor 1, thereby to keep the speed of the section 3, at least once, at a particular value for that predetermined period.

3. Second means for gradually lowering the output frequency F of the inverter 51 at the stop of the fluid compressor 1, thereby to gradually decreasing the rotational speed N of the section 3.

4. Third means for maintaining the output frequency F at least once, at a prescribed value for a predetermined period at the stop of the fluid compressor 1, thereby to keep the speed of the section 3, at least once, at a particular value for that predetermined period.

Figure 7:
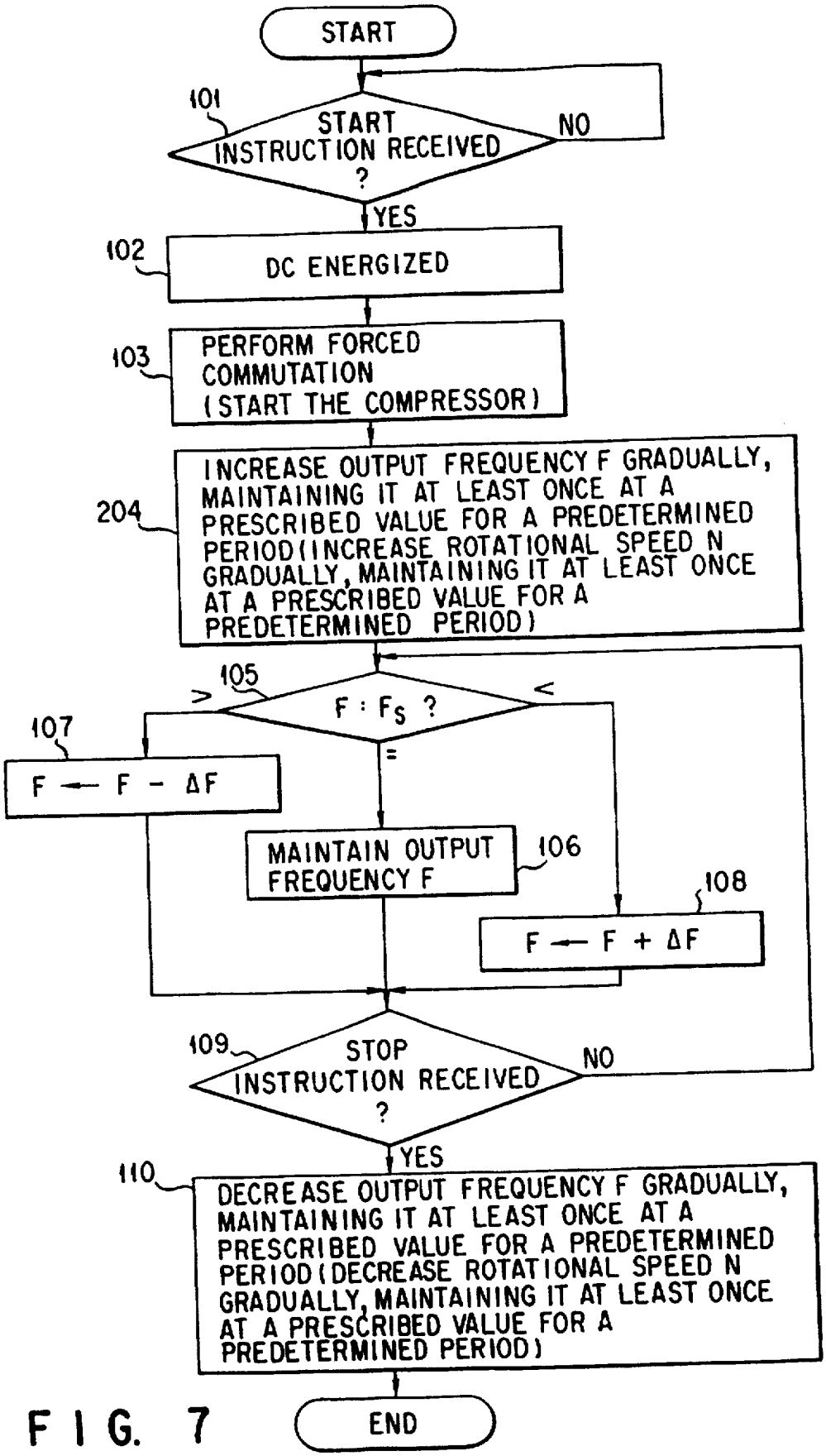
FIG. 7 is a flow chart explaining the operation of a refrigerating apparatus according to the second embodiment of the invention.

The second embodiment operates in the same way and achieves the same advantages as the first embodiment, except for the following points. Step 204 is performed instead of Step 104 (FIG. 4) as is seen from the flow chart of FIG. 7. In Step 204, the output frequency F of the inverter 51 is gradually increased. It is maintained at a prescribed value for a predetermined period t, at least once, while being gradually increased. Therefore, the rotational speed N of the electric motor section 3 is gradually increased, but maintained at a prescribed value $N_2$ for the predetermined period t, as is shown in FIG. 8A.

Since the rotational speed N of the section 3 is gradually increased, step by step, at the start of the fluid compressor 1, the compressor 1 vibrates much less and makes far less noise than its counterpart incorporated in the conventional refrigerating apparatus.

In the second embodiment, the predetermined period t may be increased and the rotational speed N of the electric motor section 3 may be maintained at a prescribed value $N_1$ less than the value $N_2$, as is illustrated in FIG. 9A. If this is the case, the vibration of the fluid compressor 1 can be suppressed still more. To be more specific, the output frequency F may maintained first at a prescribed value $F_1$ for the period t and then at a prescribed value $F_2$ for the period t, while it is being increased. In this case, the rotational speed N of the section 3 is gradually increased, maintained at the value $N_1$ for the period t, gradually increased, and maintained at the value $N_2$ for the period t, and gradually increased further, as is illustrated in FIG. 10.

An optimal value for the rate of decreasing the output frequency F of the inverter 51 ranges from 0.1 to 5 Hz/sec. Optimal values for the predetermined period t ranges from 15 seconds to 5 minutes. Optimal values for the prescribed output frequency $F_1$ and $F_2$ range from 10% to 50% of the maximum frequency allowable value Fmax.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A refrigerating apparatus comprising:

a fluid compressor having a sealed case filled with lubricant, a compression section provided in said sealed case, and an electric motor section provided in said sealed case, said compression section and said electric motor section having axes extending substantially horizontally;

a control circuit for increasing a rotational speed of said electric motor section after said fluid compressor is started; and an inverter for supplying drive power to said electric motor section;

wherein said control circuit increases an output frequency of said inverter at a rate of 0.1 to 5 Hz per second after said fluid compressor is started.

2. A refrigerating apparatus comprising:

a fluid compressor having a sealed case filled with lubricant a compression section provided in said sealed case, and an electric motor section provided in said sealed case, said compression section and said electric motor section having axes extending substantially horizontally; and a control circuit for gradually increasing a rotational speed of said electric motor section after said fluid compressor is started maintaining said rotational speed of said electric motor section at a prescribed value for a predetermined period, and then continuing to gradually increase said rotational speed after said predetermined period.

3. The refrigerating apparatus according to claim 2, further comprising an inverter for supplying drive power to said electric motor section.

4. The refrigerating apparatus according to claim 3, wherein said control circuit increases an output frequency of said inverter at a rate of 0.1 to 5 Hz per second to a prescribed frequency value of 10% to 50% of a maximum frequency allowable after said fluid compressor is started, maintains said output frequency of said inverter at said prescribed frequency value of 10% to 50% of said maximum frequency allowable for said predetermined period, and then continues to increase said output frequency at said rate of 0.1 to 5 Hz per second after said predetermined period.

5. A refrigerating apparatus comprising:

a fluid compressor having a sealed case filled with lubricant, a compression section provided in said sealed case, and an electric motor section provided in said sealed case, said compression section and said electric motor section having axes extending substantially horizontally;

a control circuit for decreasing a rotational speed of said electric motor section when said fluid compressor is stopped; and an inverter for supplying drive power to said electric motor section;

wherein said control circuit decreases an output frequency of said inverter at a rate of 0.1 to 5 Hz per second when said fluid compressor is stopped.

6. A refrigerating apparatus comprising:

a fluid compressor having a sealed case filled with lubricant, a compression section provided in said sealed case, and an electric motor section provided in said sealed case, said compression section and said electric motor section having axes extending substantially horizontally; and a control circuit for gradually decreasing a rotational speed of said electric motor section when said fluid compressor is stopped, maintaining said rotational speed of said electric motor section a prescribed value for a predetermined period, and then continuing to gradually decrease said rotational speed after said predetermined period.

7. The refrigerating apparatus according to claim 6, further comprising an inverter for supplying drive power to said electric motor section.

8. The refrigerating apparatus according to claim 7, wherein said control circuit decreases an output frequency of said inverter at a rate of 0.1 to 5 Hz per second to a prescribed frequency value of 5% to 30% of a maximum frequency allowable when said fluid compressor is stopped, maintains said output frequency of said inverter at said prescribed frequency value of 5% to 30% of said maximum frequency allowable for said predetermined period, and then continues to decrease said output frequency at said rate of 0.1 to 5 Hz per second after said predetermined period.

9. A refrigerating apparatus comprising:

a fluid compressor having a sealed case filled with lubricant, a compression section provided in said sealed case, and an electric motor section provided in said sealed case, said compression section and said electric motor section having axes extending substantially horizontally;

a control circuit for increasing a rotational speed of said electric motor section after said fluid compressor is started and for decreasing said rotational speed of said electric motor section when said fluid compressor is stopped; and an inverter for supplying drive power to said electric motor section;

wherein said control circuit increases an output frequency of said inverter at a rate of 0.1 to 5 Hz per second after said fluid compressor is started and decreases said output frequency of said inverter at a rate of 0.1 to 5 Hz per second when said fluid compressor is stopped.

10. A refrigerating apparatus comprising:

a fluid compressor having a sealed case filled with lubricant, a compression section provided in said sealed case, and an electric motor section provided in said sealed case, said compression section and said electric motor section having axes extending substantially horizontally; and a control circuit for gradually increasing a rotational speed of said electric motor section after said fluid compressor is started, gradually decreasing said rotational speed of said electric motor section when said fluid compressor is stopped maintaining said rotational speed of said electric motor section at a first prescribed value for a first predetermined period, and maintaining said rotational speed of said electric motor section at a second prescribed value for a second predetermined period, wherein said control circuit gradually increases said rotational speed to said first prescribed value after said fluid compressor is started, maintains said rotational speed at said first prescribed value for said first predetermined period, and then continues to gradually increase said rotational speed after said first predetermined period; and said control circuit gradually decreases said rotational speed to said second prescribed value after said fluid compressor is stopped, maintains said rotational speed at said second prescribed value for said second predetermined period, and then continues to gradually decrease said rotational speed after said second predetermined period.

11. The refrigerating apparatus according to claim 10, further comprising an inverter for supplying drive power to said electric motor section.

12. The refrigerating apparatus according to claim 11, wherein said control circuit increases an output frequency of said inverter at a rate of 0.1 to 5 Hz per second to a first prescribed frequency value of 10% to 50% of a maximum frequency allowable after said fluid compressor is started, maintains said output frequency of said inverter at said first prescribed frequency value of 10% to 50% of said maximum frequency allowable for said first predetermined period, and continues to increase said output frequency at said rate of 0.1 to 5 Hz per second after said first predetermined period, and said control circuit decreases said output frequency of said inverter at a rate of 0.1 to 5 Hz per second to a second prescribed frequency value of 5% to 30% of said maximum frequency when said fluid compressor is stopped, maintains said output frequency of said inverter at said second prescribed frequency value of 5% to 30% of said maximum frequency allowable for said second predetermined period, and then continues to decrease said output frequency at said rate of 0.1 to 5 Hz per second after said second predetermined period.

13. A refrigerating apparatus according to claim 11 wherein said electric motor section is a brushless DC motor.

* * * * *